US011565537B2

(12) United States Patent
Mindler et al.

(10) Patent No.: US 11,565,537 B2
(45) Date of Patent: Jan. 31, 2023

(54) ADJUSTABLE SLITTERS FOR ACCURATE TRANSPORT-WISE CUTTING OF PRINTED MEDIA

(71) Applicant: Kodak Alaris Inc., Rochester, NY (US)

(72) Inventors: Robert Mindler, Rochester, NY (US); Richard Paoletti, Rochester, NY (US); Joseph Repass, Rochester, NY (US)

(73) Assignee: KODAK ALARIS INC., Rochester, NY (US)

( * ) Notice: Subject to any disclaimer, the term of this patent is extended or adjusted under 35 U.S.C. 154(b) by 0 days.

(21) Appl. No.: 16/992,785

(22) Filed: Aug. 13, 2020

(65) Prior Publication Data

US 2021/0053373 A1 Feb. 25, 2021

Related U.S. Application Data

(60) Provisional application No. 62/890,249, filed on Aug. 22, 2019.

(51) Int. Cl.

| | |
|---|---|
| ***B41J 11/66*** | (2006.01) |
| ***B41J 2/32*** | (2006.01) |
| ***B41J 11/68*** | (2006.01) |
| ***B41J 29/393*** | (2006.01) |

(52) U.S. Cl.

CPC ..... *B41J 11/663* (2013.01); *B41J 2/32* (2013.01); *B41J 11/68* (2013.01); *B41J 29/393* (2013.01)

(58) Field of Classification Search

CPC ... B41J 11/663; B41J 2/32; B41J 11/68; B41J 29/393; B41J 11/0065; B41J 11/008; B26D 5/007; B26D 5/00

See application file for complete search history.

(56) References Cited

U.S. PATENT DOCUMENTS

| | | | | |
|---|---|---|---|---|
| 6,536,892 | B1 * | 3/2003 | Chang | B41J 11/008 347/101 |
| 6,624,876 | B2 * | 9/2003 | Fukuda | G03B 27/73 355/29 |
| 2003/0107640 | A1 * | 6/2003 | Chang | B41J 11/008 347/107 |
| 2005/0219590 | A1 * | 10/2005 | Andersen | H04N 1/3872 358/1.12 |
| 2009/0193948 | A1 * | 8/2009 | Innes | B41J 11/70 83/334 |
| 2010/0258017 | A1 * | 10/2010 | Kersey | B41J 11/68 101/227 |
| 2014/0355016 | A1 * | 12/2014 | Kondo | H04N 1/6033 358/1.9 |
| 2016/0144636 | A1 * | 5/2016 | Kotaka | H04N 1/3878 347/104 |
| 2018/0222217 | A1 | 8/2018 | Singla et al. | |
| 2018/0281218 | A1 * | 10/2018 | Urrutia Nebreda | B41J 11/66 |
| 2020/0391973 | A1 * | 12/2020 | Mulder | B26D 1/045 |

* cited by examiner

*Primary Examiner* — Thinh H Nguyen

(74) *Attorney, Agent, or Firm* — Hogan Lovells US LLP

(57) ABSTRACT

Various embodiments of systems and methods facilitate the calibration of a printer. The printer can print a calibration target and cut the calibration target using an inline slitter. The printer can determine a calibration offset based on the position of the cut on the calibration target. The printer can then be calibrated according to gross amounts on the slitter and fine amounts at an ink applicator.

20 Claims, 9 Drawing Sheets

ADJUSTABLE SLITTERS FOR ACCURATE TRANSPORT-WISE CUTTING OF PRINTED MEDIA

CROSS REFERENCE TO RELATED APPLICATION

The present application is a non-provisional of and claims priority to U.S. provisional patent application No. 62/890,249, titled "ADJUSTABLE SLITTERS FOR ACCURATE TRANSPORT-WISE CUTTING OF PRINTED MEDIA," filed on Aug. 22, 2019. The disclosure of the above-identified application is hereby incorporated by reference in its entirety.

BACKGROUND

While a white margin surrounding printed material is desirable in certain applications, other applications such as photographs are expected to have an image that extends to the edges of the material. A significant challenge to accomplishing such edge-to-edge printing is aligning the edge with the ink applicator. Some techniques to achieve this involve applying ink beyond the target print region. If the print region is pre-cut, then the ink will not be applied or will fall into space in the printer, if the material is not pre-cut, a printer might print beyond the target print size and the excess "bleed" will be trimmed off. These techniques waste ink, create chads of discarded material that must be periodically emptied, and prevent side-by-side printing.

BRIEF DESCRIPTION OF THE DRAWINGS

Various embodiments in accordance with the present disclosure will be described with reference to the drawings.

DETAILED DESCRIPTION

In the following description, various embodiments will be described. For purposes of explanation, specific configurations and details are set forth in order to provide a thorough understanding of the embodiments. The embodiments described herein may be modified or adapted to combine and practice the features disclosed with or without other well-known features, which may not be specifically discussed in order to not obscure the certain embodiments being described.

Figure 1:
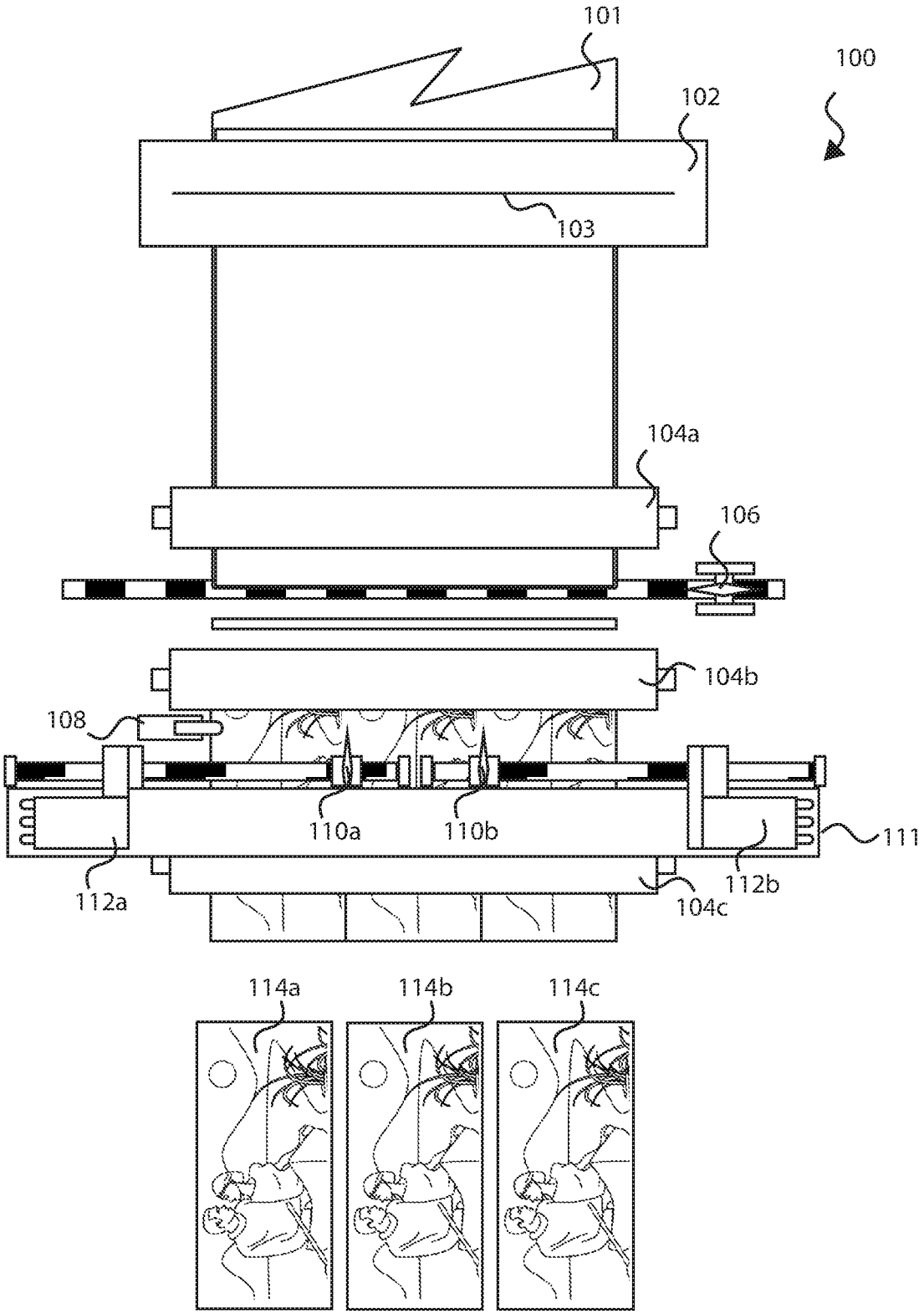
FIG. 1 illustrates an exemplary printer configured to achieve the capabilities described herein, including applying ink to a print medium and cutting pictures from the print medium.

FIG. 1 illustrates an exemplary printer 100 configured to and capable of applying ink to a print medium 101 and cutting pictures 114*a-c* from the medium. Printer 100 can include an ink applicator 102, rollers 104*a*-104*c*, lateral cutter 106, edge detector 108, inline slitters 110*a*-110*b* and other features to assist in manipulating the print medium 101 to generate pictures 114*a*-114*c*. Printer 100 can be a kiosk-style printer encased in a small package for placement on a store floor. Printer 100 can be a commercial-size printer designed for easy maintenance and high volume. The print medium 101 can be any type of photo paper or print media, such as print media specially designed to receive ink. The print medium 101 can be individual sheets or pieces, or it can be provided on a large roll and fed into printer 100. It should be understood that the order of components depicted in FIG. 1 and elsewhere is not the only contemplated arrangement. For example alternative orderings and arrangements of components are contemplated, such as positioning the ink applicator 102 after inline slitters 110.

Printer 100 can utilize a variety of ink application techniques. For example, printer 100 can be an impact printer (commonly called a "dot matrix" printer), dye sublimation printer, inkjet printer, laser printer, direct thermal printer, thermal transfer printer, etc. As such, the ink applicator 102 can include inkjets, a thermal strip, or other means for applying ink to the print medium 101. A thermal transfer printer embodiment is depicted in FIG. 1. Donor ink can be fed through the ink applicator 102, whereby the thermal strip 103 can cause the donor ink to transfer to the print medium 101. This technique is called thermal transfer printing. A full-color picture can be created using multiple colors of donor ink.

A computer (e.g., a computer processor in printer 100 running printer firmware) can control the rollers (e.g., 104*a*-104*c*) such that the print medium 101 passes under/through the ink applicator 102 at a determined rate or controlled manner. When a particular portion of the print medium is underneath the ink applicator 102, the computer can instruct the ink applicator 102 to apply various densities and colors of ink to specific portions of the print medium 101. The computer can incorporate calibration parameters to accurately apply ink to a desired location on the print medium 101.

Printer 100 can include one or more lateral cutters 106 to remove a section of material from the rest of print medium 101. For example, if the print medium is 6 inches wide, the system can feed 4 inches of print medium 101 past the lateral cutter 106 and then engage the lateral cutter 106 to create a 4 in.×6 in. piece of print medium 101. The lateral cutter 106 and other cutters discussed herein (e.g., inline slitters 110*a*-110*b*) can include a cutting blade, circular cutting blade, kiss-cutting blade, a perforation blade, a creasing blade, and/or scoring blade or other means for dividing the print medium 101. The lateral cutter 106 can include a cutting blade that cuts print medium 101 perpendicularly to the direction of print media transport and either makes two passes with a small print media advance in between to cut out a chad of waste media or uses two blades mounted in close proximity to each other that cut a small section of waste media in a single pass. The lateral cutter 106 can be selectively engaged to cut print media.

Printer 100 can include an edge detector 108. The edge detector can identify the location of an edge of the print medium 101 as it moves through the printer 100. For example, the edge detector 108 can determine that the print medium 101 is shifted to the right or left of the transport path. The edge detector 108 can include optical sensors that are obstructed when the print medium 101 passes the edge detector 108. The edge detector can also be utilized to determine the location of the print medium 101 along a transport path. For example, when the edge detector 108 first detects the print medium 101, the printer 100 can determine that the leading edge of the print medium 101 is at the edge detector 108. The edge detector 108 can be a linear or area array optical sensor that monitors the absolute and relative position of the media edge as the media is transported through the printer to verify that the print medium 101 is tracking properly and to identify problem conditions such as media transport skew.

Printer 100 can include one or more inline slitters 110*a*-110*b*. An inline slitter can cut the printed medium 101 along the transport path to divide it into sub-sections such as pictures 114*a*-114*c*. The inline slitters can include a cutting blade, circular cutting blade, kiss-cutting blade, a perforation blade, a creasing blade, and/or scoring blade or other means for dividing the print medium 101.

The inline slitters 110*a*-110*b* can be controlled by respective controllers 112*a*-112*b*. The inline slitters 110*a*-110*b* can be attached to a slitter bracket 111. A controller (112*a* and/or 112*b*) can move the associated inline slitter 110 to an appropriate position for a desired cut. The appropriate position can be outside of the transport path to effectively disable the inline slitter 110. If there are multiple inline slitters (e.g., 110*a* and 110*b*), each can be configured to be positioned anywhere across the print medium 101, not solely according to left/right regions. For example, both inline slitters 110*a*-110*b* in FIG. 1 might be positioned to the far right of the transport path thus enabling the cutting of two thin strips and one larger image.

After precise calibration of the ink applicator 102, inline-slitters 110*a*-110*b*, etc. pictures 114*a*-114*c* can be printed of various sizes without errors. For example, because the inline slitter 110*a* that separates picture 114*a* and 114*b* is precisely calibrated with the ink applicator 102, no appreciable part of the sky from picture 114*b* will be visible in picture 114*a* and no appreciable part of the water/ground from 114*a* will be visible in picture 114*b*.

Figure 2A:
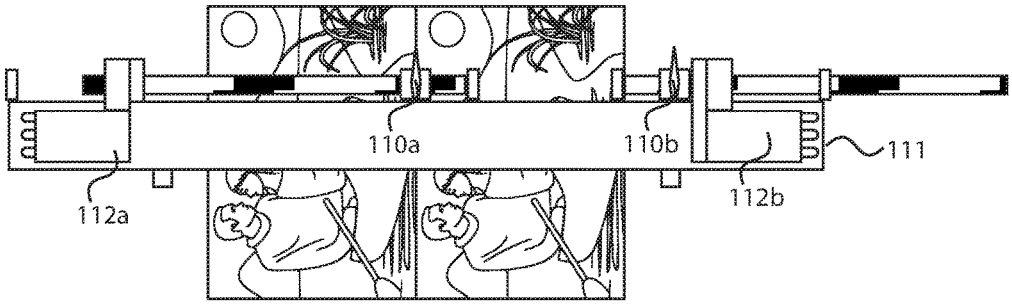
FIGS. 2A-2B illustrate embodiments of a printer comprising inline slitters and method of using the same.
Figure 2B:
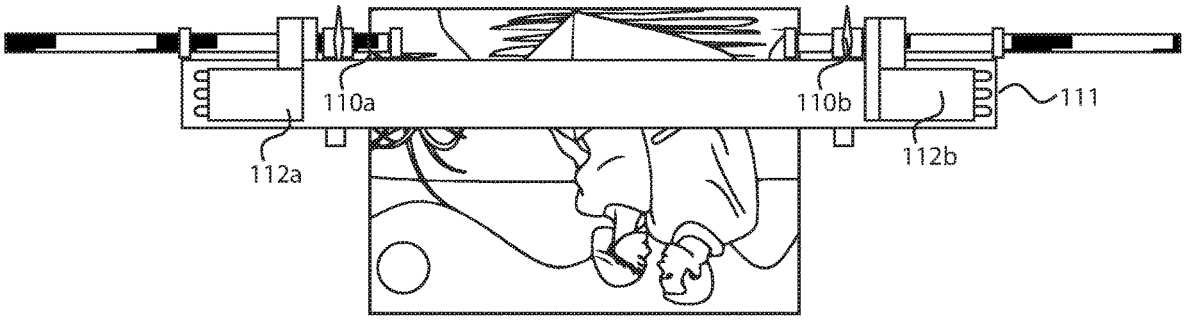

FIGS. 2A and 2B illustrate example uses of inline slitters 110*a*-110*b*. In FIG. 2A, the right inline slitter 110*b* has been relocated by the slitter controller 112*b* to the right-most extreme of the slitter bracket 111. Meanwhile, the left inline slitter 110*a* has been positioned by the slitter controller 112*a* to the center of the slitter bracket 111. This can enable the printer 100 to cut the print medium 101 in half. Various configurations are contemplated. For example, a 6-inch wide media roll can be cut into one 4-inch wide and one 2-inch wide prints, two 3-inch wide prints, three 2-inch wide prints, etc. The accurate calibration of the inline slitters 110*a*-110*b* with the ink applicator can result in cuts that are precisely in line with where two images abut. This minimizes bleed-over (inked portions of one image being included with another image). If a customer orders a 4-inch wide print, the smaller portion can be used to show the print in smaller sizes (e.g., wallet size pictures) or advertisements. In some embodiments, the edges of adjacent images can be digitally blended to minimize high-contrast areas that might be apparent if the slitters are slightly misaligned with the ink applicator.

The inline slitters 110 can be configured along a certain transport path. When slitters are not required (e.g., for full-width prints), the print medium 101 can be directed along an alternate transport path. Each inline slitter can have a respective "side" of the print. Alternatively, each inline slitter can span the entire width of the print. In FIG. 2B, for example, the left inline slitter 110*a* has been positioned at the left-most extremity of the slitter bracket 111 while the right inline slitter 110*b* has been positioned at the right-most extremity of the slitter bracket 111. As the print medium 101 passes the slitter bracket 111, it does not engage the inline slitters 110*a*-110*b*, resulting in a full-width picture.

The inline slitters 110*a*-110*b* can be cutting blades, such as fixed straight or circular rotating blades that cut the print medium 101 in the direction of media transport. They can be selectively engaged to slit the print medium 101. The cutters/slitters described herein can include perforation capabilities, creasing capabilities, scoring capabilities, etc. for making greeting cards, tickets, coupons, etc. The slitter mechanism can include a "locating boss" or stud that interfaces with a slot on the slitter bracket for large adjustments. Each inline slitter can have respective slots in the slitter bracket to adjust the inline slitter perpendicularly to the transport path.

Figure 3A:
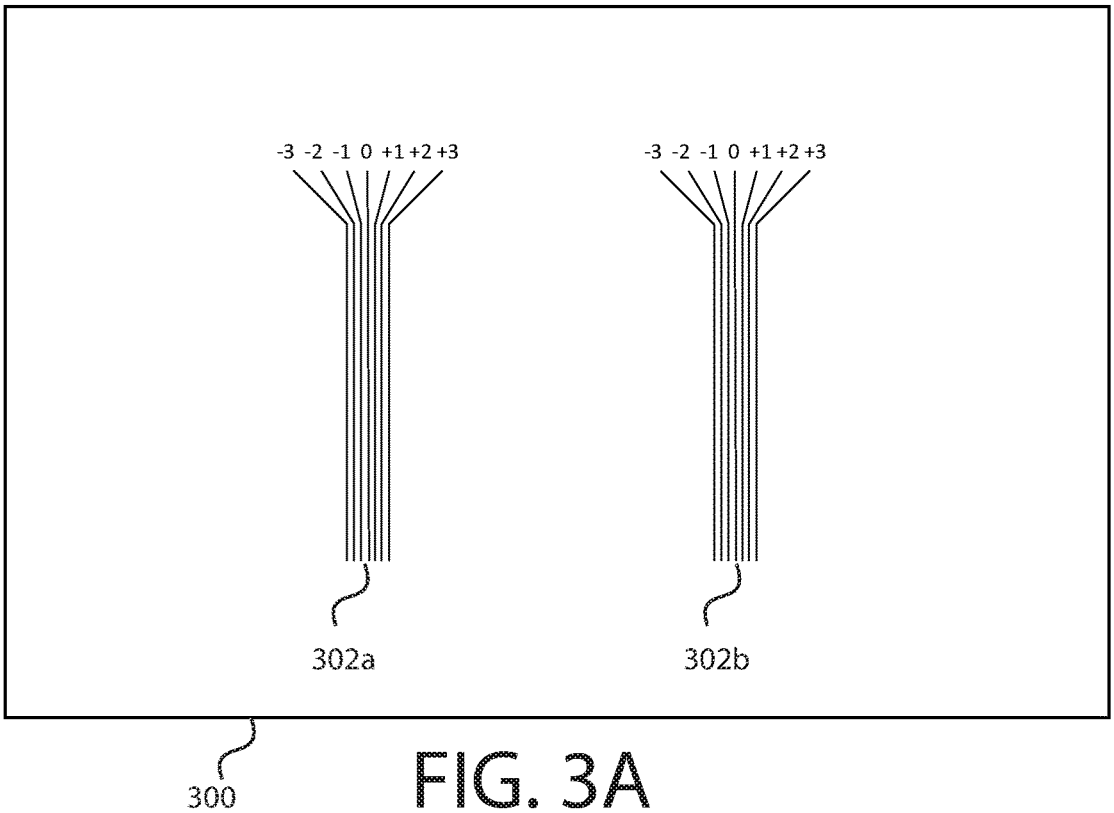
FIG. 3A illustrates an example of a calibration target.
Figure 3B:
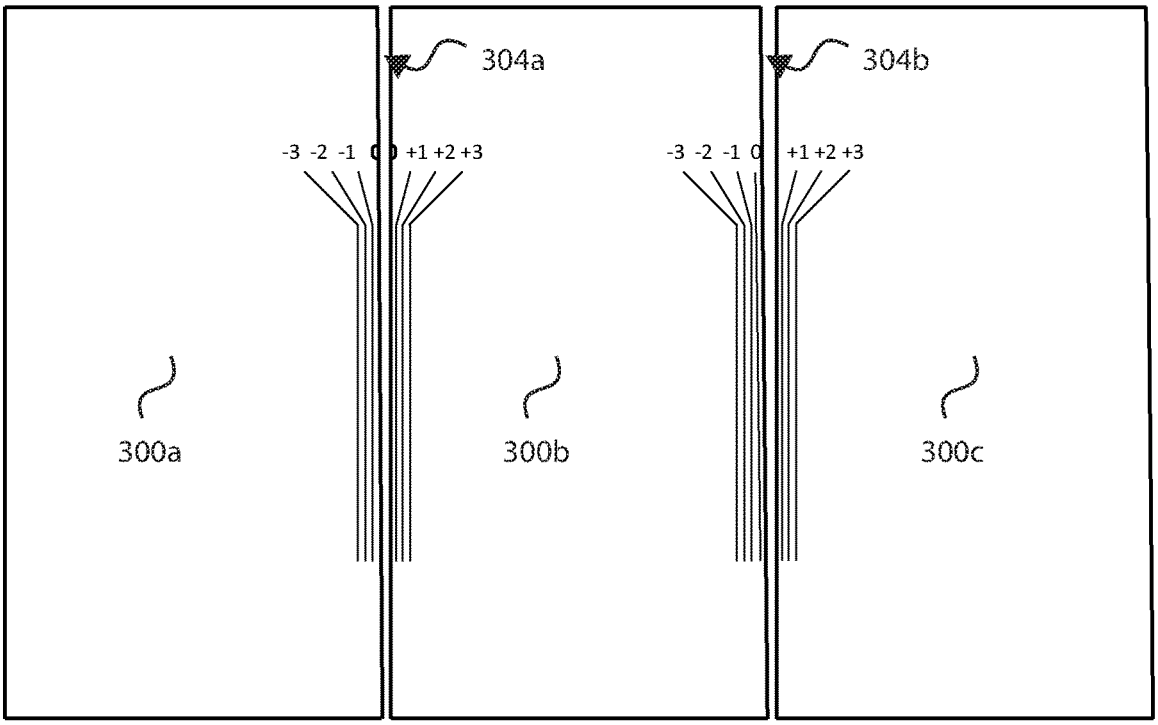
FIG. 3B illustrates an exemplary use of calibration targets on a print medium.

FIGS. 3A-3B illustrate example calibration targets 302*a*-302*b*. Printer 100 can print the calibration target on a calibration sheet 300. When the calibration sheet 300 is fed through the inline slitters 110*a*-110*b*, the inline slitters 110*a*-110*b* can create cuts 304*a*-304*b* in the calibration sheet 300. A human operator or a computer sensor can compare the cuts 304*a*-304*b* with the calibration targets 302*a*-302*b* to determine left-right calibration offsets for the inline slitters 110*a*-110*b* and/or other components of printer 100 to ensure proper alignment of future cuts with ink placement.

Figure 4:
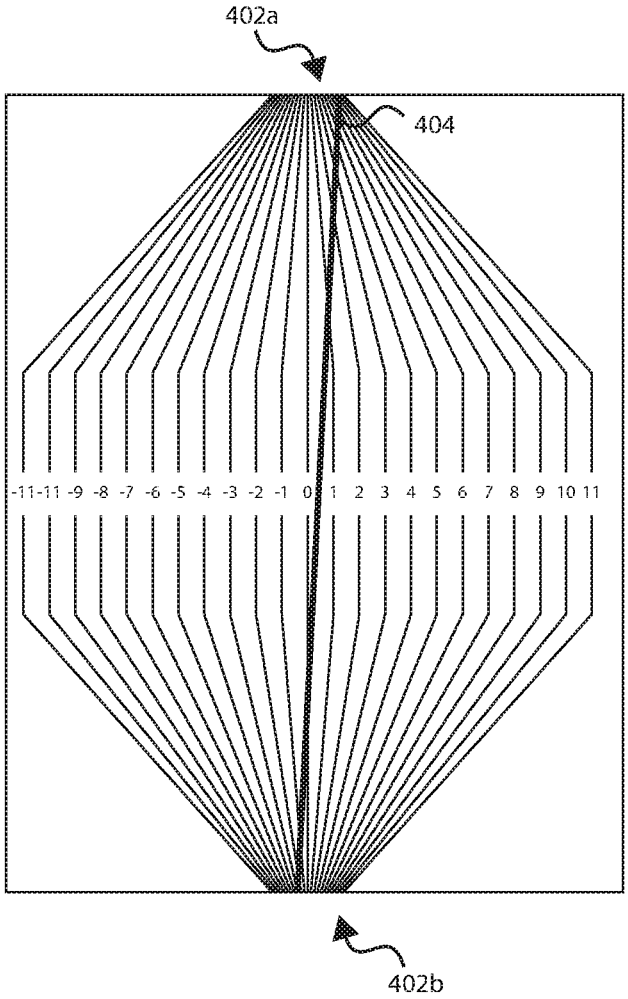
FIG. 4 illustrates how a calibration target with two regions can help identify rotation of an inline slitter.

FIG. 4 illustrates how a calibration target with two regions 402*a*-402*b* can help identify rotation of an inline slitter 110. For example, a human operator and/or computer sensor can detect where a cut 404 crosses a top region 402*a* of the calibration target and a bottom region 402*b* of the calibration target. Using these values, the system can detect left-right offset of the inline slitter 110 as well as incorrect rotation of the inline slitter 110.

Figure 5:
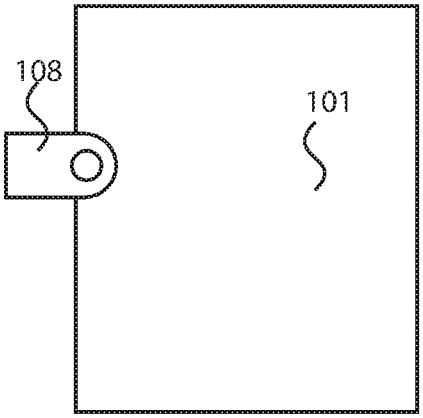
FIG. 5 illustrates an example edge detector and print medium.

FIG. 5 illustrates an example edge detector 108 and print medium 101. As discussed previously, the edge detector 108 can detect the edge of the print medium 101 as it passes through/below the edge detector 108. This can be useful to determining a lateral (side to side) position of the print medium 101 and can be used for calibration of the printer 100. The edge detector 108 can be used to make calibration adjustments in real-time. Mechanical edge detectors are also contemplated.

Figure 6:
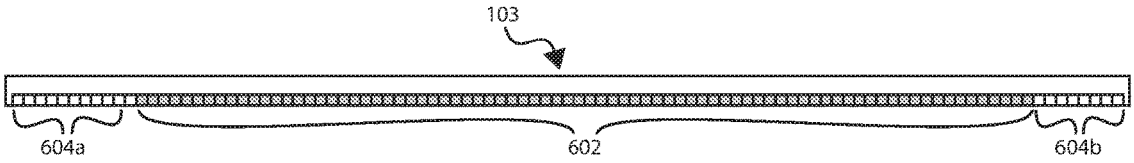
FIG. 6 illustrates an example thermal strip for transferring ink from a donor ink to the print medium.

FIG. 6 illustrates an example thermal strip 103 for transferring ink from a donor ink to the print medium 101. As the donor ink and print medium pass 101 the thermal strip 103, various resistors are activated on the thermal strip 103 to produce heat which causes ink to transfer to the print medium 101. The thermal strip 103 can be wider than the print medium 101 such that only an active region 602 can be used which corresponds to the print medium 101 while other regions 604*a*-604*b* which extend beyond the edge of the print medium 101 can be deactivated. In order to calibrate the printer 100, the active region 602 can be shifted left or right. This can be considered digitally calibrating the printer. The thermal strip 103 can have a resolution of 300 pixels per inch; thus, calibration can be effective for 1/300th of an inch by moving the image one pixel left or right.

Figure 7:
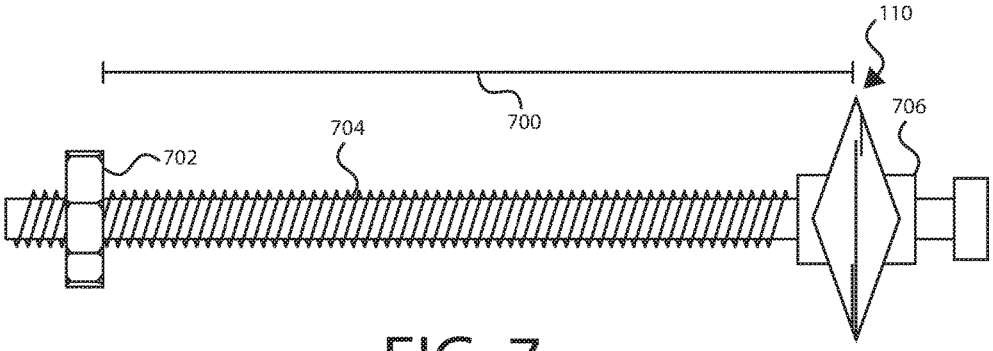
FIG. 7 illustrates an example inline slitter comprising a threaded rod, a slitter carriage, and a fixed nut.

FIG. 7 illustrates an example inline slitter 110 comprising a threaded rod 704, a slitter carriage 706, and a fixed nut 702. In some configurations, the threaded rod 704 can be rotated causing the rod and slitter carriage 706 to move laterally. For example, the slitter carriage 706 can be fixed to the threaded rod 704 and the nut 702 can be fixed to the printer 100 housing. In other configurations, the slitter carriage 706 can prevented from rotating but can slide freely along the slitter bracket 111 as the threaded rod 704 rotates. The slitter can be moved laterally using a rack and pinion gear arrangement. Other techniques to enable lateral movement are contemplated. A stepper motor, conventional motor, encoder wheels, variable resistors, etc. can be used to control the position of the inline slitter 110. The inline slitter 110 can be placed on a mounting shaft that includes detents at fixed intervals (e.g., every few millimeters). A carriage can move the inline slitter 100 to the desired location and the inline slitter 100/carriage can engage the detent to ensure stability at the location. A shaft lock can be used to ensure the inline slitter 110 does not move when engaged.

In order to determine the current position of the inline slitter 110, various techniques can be implemented. The controller 112 can be a stepper motor that accurately tracks the movements of the slitter carriage 706 to determine the expected position of the inline slitter. An encoder can be used to determine the position of the inline slitter 110. The possible locations of the inline slitter 110 are depicted by range 700. Multiple inline slitters 110 can be positioned at different locations along the transport path such that each slitter can move independently, regardless of the positions of other slitters.

Figure 8A:
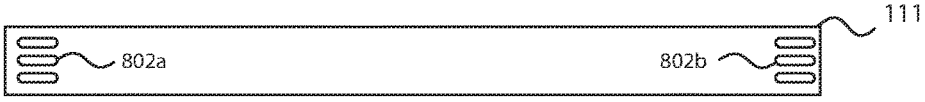
FIG. 8A illustrates an example slitter bracket.
Figure 8B:
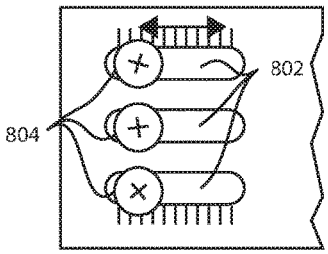
FIGS. 8B-8C illustrate exemplary bracket configurations and slitter holes.
Figure 8C:
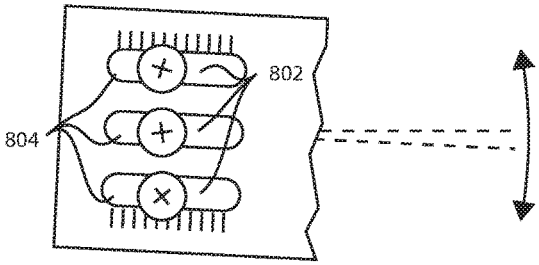
Figure 9A:
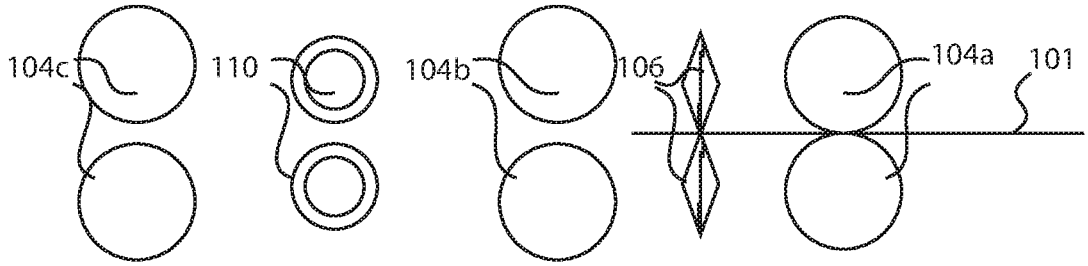
FIGS. 9A-9D illustrate exemplary transport paths for a piece of print medium through a printer.
Figure 9B:
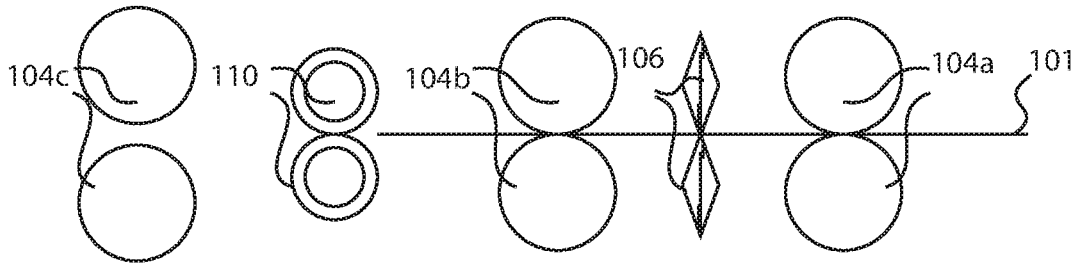
Figure 9C:
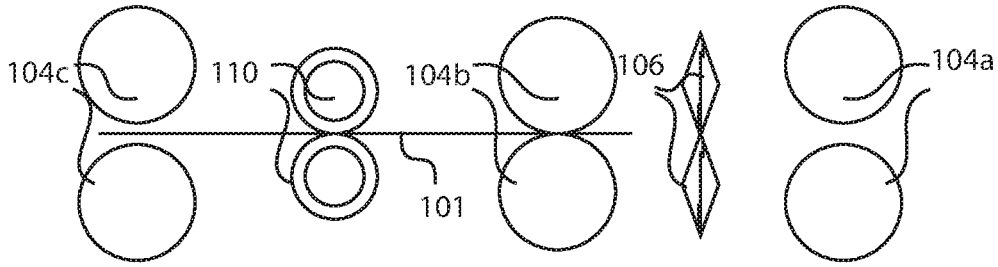
Figure 9D:
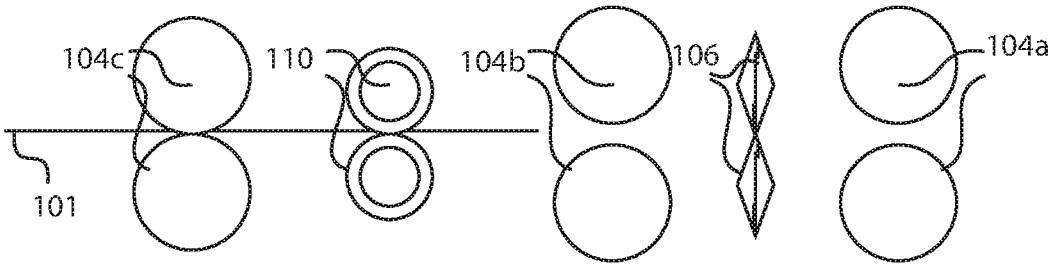

FIG. 8A-8C illustrate example slitter bracket 111 configurations and slitter holes 802*a*-802*b*. The slitter holes accommodate manual adjustments left and right. Indicators with the slitter holes 802 can be used to adjust the slitter bracket 111 by aligning screws 804 with the appropriate indicator. For example, the system can instruct an operator to place the screws 804 at an indicator number −4. If rotation is required for the slitter bracket 111, for example to correct for a rotation/skew depicted in FIG. 4, a screw 804 at the top can be positioned at one indicator while a screw 804 at the bottom can be positioned at a different indicator, causing the slitter bracket 111 to have a slight rotation. The cutting element of inline slitter 110 can be angled to accomplish a similar effect. For example, if the cutting element is a blade, the blade can be turned to a desired angle. In some configurations, the printer 100 can automatically adjust the cutting element to de-skew an image or to create customizable edge shapes (e.g., a wave pattern).

FIGS. 9A-9D illustrate an example transport path for print medium 101. A portion of print medium 101 can be fed through a first roller 104*a* and past lateral cutter 106. This can be accomplished while a first roller 104*a* is engaged while other elements are disengaged. After extending past the lateral cutter 106 a predetermined amount, the second roller 104*b* can engaged and the lateral cutter 106 can go across the print medium 101 to create a cut. The lateral cutter 106 can then be located out of the transport path. The first roller 104*a* can disengage the print medium 101 as the second roller 104*b* pushes the print medium 101 through the inline slitter 110 which has been engaged. The third roller 104*c* can then engage the print medium 101 and pull it across the inline slitter 110 while the second roller 104*b* is disengaged. The print medium 101, now cut to the desired size, can be retrieved by the customer/operator. The rollers 104 can be opposing soft compliant drive rollers that use pressure and friction to advance the print medium 101 through the printer 101.

By placing rollers 104 before and after the lateral cutter 106 and before and after the inline slitter 110, the printer 100 can achieve more accurate cuts. These rollers 104 can also improve the print medium 101 transport by decreasing skew and lateral movement. By limiting how many rollers 104 are engaged at a time, the printer 104 can also decrease stress on the print medium 101 which might result in skew, rotation, or distortion of the print medium 101. One or more rollers 104 can have a one-way clutch to prevent roll-back of the print medium 101. Some rollers 104 can be bidirectional. For example, a roller can move the print medium 101 across the ink applicator 102 multiple times, once for each color of ink.

Figure 10:
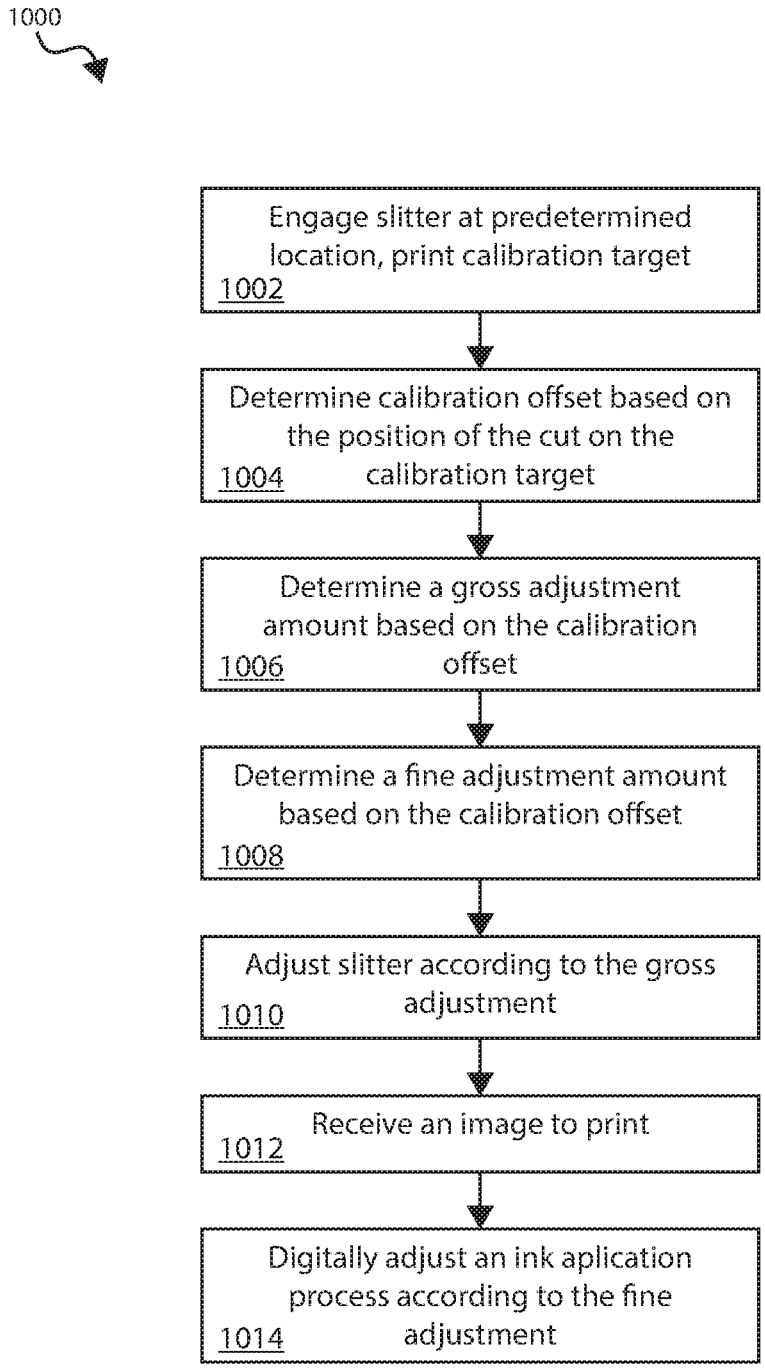
FIG. 10 illustrates an exemplary printer calibration process.

FIG. 10 illustrates an example method 1000 for calibrating a printer 100. It should be understood that the steps presented herein can be performed in any appropriate order, some steps may be repeated and some steps may be performed simultaneously. Some steps may be added, omitted, combined, altered, etc. An inline slitter 110 can be engaged at a predetermined location and a calibration target 302 can be printed (step 1002). Engaging the inline slitter 110 can include moving it into the transport path of the print medium 101. Engaging the inline slitter 110 can include moving it from a position above the transport path (e.g., above where the print medium 101 will pass) to a position on the transport path (e.g., bringing it down such that the print medium 101 will be engaged by the inline slitter 110). Multiple inline slitters 110 can be calibrated simultaneously using the techniques disclosed herein. For example, two inline slitters 110 can be engaged and multiple calibration targets can be printed (e.g., side by side) on the print medium 101.

The system can determine a calibration offset based on the position of the resulting cut on the calibration target 302 (step 1004). For example, a human operator can determine where the cut was performed relative to the calibration target. Lines and indicia on the calibration target can assist the human operator to determine the calibration offset without the aid of an optical aid such as a magnifying glass. The calibration target can be used to determine lateral offset as well as skew as demonstrated herein. The human operator can input the appropriate offset into a terminal associated with the printer 100.

Printer 100 can include digital means for determining the calibration offset automatically. For example, a camera can read a pattern in the calibration target and the cut to detect the exact location of the cut relative to the calibration target. A light opposite the print medium 101 can be activated to aid in the cut identification. The system can determine a gross adjustment amount based on the calibration offset (step 1006). The system can determine a fine adjustment amount based on the calibration offset (step 1008). As an example, the slitter bracket may have three positions corresponding to an offset of −0.125 inches, 0 inches, and 0.125 inches, while the ink applicator can be adjusted according by increments of 0.0033 inches (e.g., at 300 pixels per inch, each ink applicator would be 1/300 inch). Thus, if an adjustment of −0.1 inches is required, a gross adjustment amount of −0.125 can be determined while a fine adjustment of +0.025 can be determined. Dividing up gross and fine adjustments help limit the size of the ink applicator. The inline slitter 110 can be adjusted according to the gross adjustment (step 1010). For example, the slitter bracket 111 can be adjusted laterally according to the gross adjustment. If an operator is performing the adjustment manually, the printer 100 can instruct the operator to move the slitter bracket to a certain position. The system can engage motors or other components to move the slitter bracket to a certain position. The individual inline slitters can be calibrated according to gross adjustments. For example, an inline slitter can be moved laterally to an appropriate detent.

The gross adjustment can include accommodating for skew/rotation of the print medium 101. For example, the gross adjustment can include pivoting the slitter bracket 111 and/or rotating the inline slitter. In some configurations, multiple inline slitters are capable of being grossly adjusted according to predetermined detents. For example, in order to facilitate cutting various widths of material, individual inline slitters can be placed (automatically or manually) at one of a dozen preconfigured detents. The detent mechanism as a whole can thus be calibrated according to a gross offset (e.g., by lateral transition of the detent mechanism). This can ensure that the inline slitters' relative distance is precisely calibrated, even while the slitters' position relative to the ink applicator may require further calibration. In some embodiments, an exact inter-slitter distance cannot be calibrated with the optimal degree of precision. For example, if a desired 2-inch separation distance cannot be obtained between the two slitters using the techniques herein disclosed (e.g., because one or both of the slitters is misaligned by a portion), the system can determine the actual distance between slitters and compensate by stretching/cropping the appropriate images to match the actual slitter locations. This could result in one print being 1.9967 inches and another being 2.0033 inches despite the intended image width being 2 inches for each.

The system can receive an image to print (step 1012). The system can receive an image over a network or from a locally accessible device. In some configurations, the system repeats the calibration process and the image to print can be another calibration target. If the image to print is a calibration target, it can be a more refined target that can help further refine the calibration system. The print need not be a picture but can be a document or other form of printed material.

The system can digitally adjust an ink application process according to the fine adjustment (step 1014). For example, in a thermal transfer printer, the active print region 602 can be adjusted left or right according to the fine adjustment. Image instructions can include a resistor offset (e.g., each pixel is offset by a number of resisters, where each resistor corresponds to a pixel). This can also be accomplished by indicating a starting resistor (e.g., resistor 36 can be the initial resistor). In other printing techniques such as inkjet printing, the find adjustment can be effected by changing the relative positioning of the cartridge movements and/or individual inkjet activations. The system can digitally move the image. For example, the system can move a digital image by a number of pixels corresponding to the fine adjustment; this can be especially useful if the system does not have direct control of the ink applicator.

Figure 11:
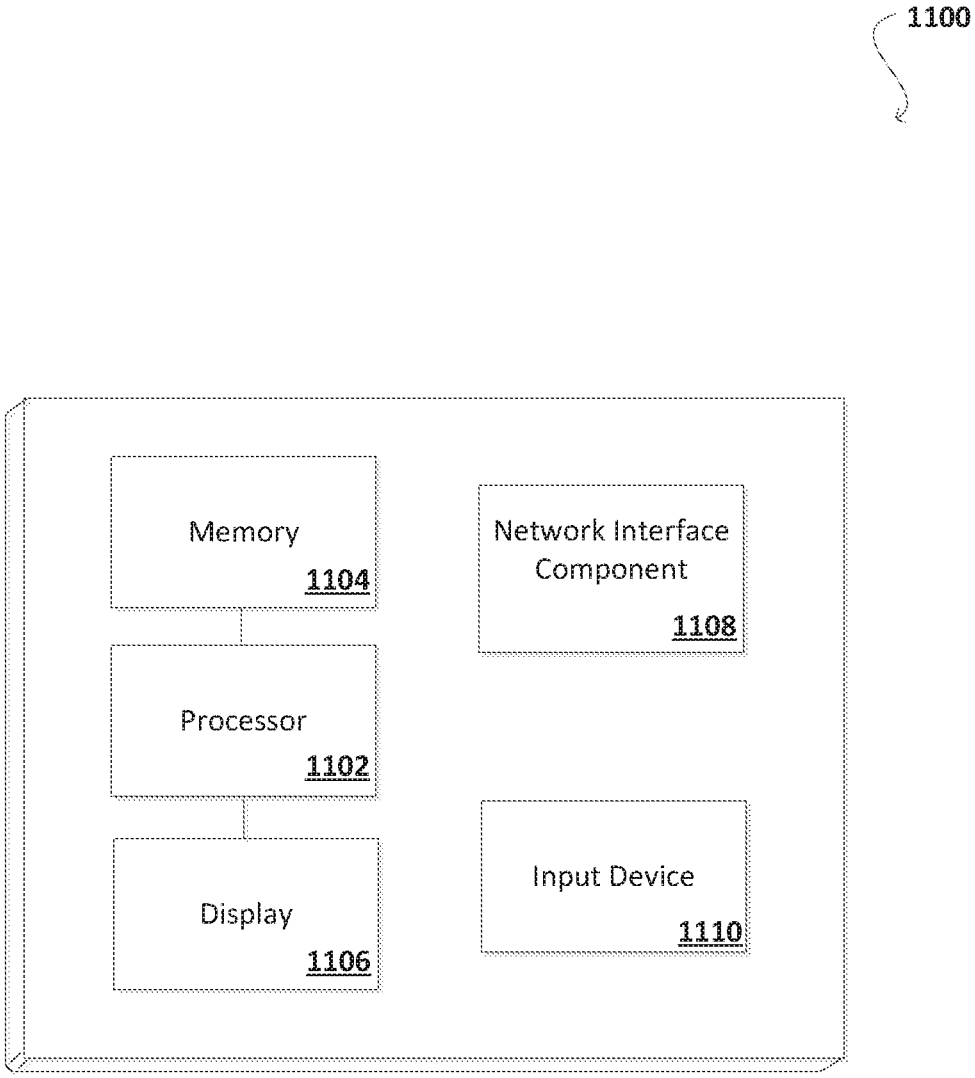
FIG. 11 illustrates exemplary components of a computing device that can be utilized in accordance with various embodiments of a printer, as described herein.

FIG. 11 illustrates a logical arrangement of a set of general components for an exemplary computing device 1100 that can be used to implement aspects of the various embodiments. In this example, the device includes a processor 1102 for executing instructions that can be stored in a memory device or element 1104. As would be apparent to one of ordinary skill in the art, the device can include many types of memory, data storage, or non-transitory computer-readable storage media, such as a first data storage for program instructions for execution by the processor 1102, a separate storage for images or data, a removable memory for sharing information with other devices, etc. The device typically will include some type of display element 1106, such as a touch screen or liquid crystal display (LCD), although devices such as portable media players might convey information via other means, such as through audio speakers. As discussed, the device in many embodiments will include at least one input element 1110 able to receive conventional input from a user. This conventional input can include, for example, a push button, touch pad, touch screen, wheel, joystick, keyboard, mouse, keypad, or any other such device or element whereby a user can input a command to the device. In some embodiments, however, such a device might not include any buttons at all, and might be controlled only through a combination of visual and audio commands, such that a user can control the device without having to be in contact with the device. In some embodiments, the computing device 1100 of FIG. 11 can include one or more network interface components 1108 for communicating over various networks, such as a Wi-Fi, Bluetooth, RF, wired, or wireless communication systems. The device in many embodiments can communicate with a network, such as the Internet, and may be able to communicate with other such devices.

Figure 12:
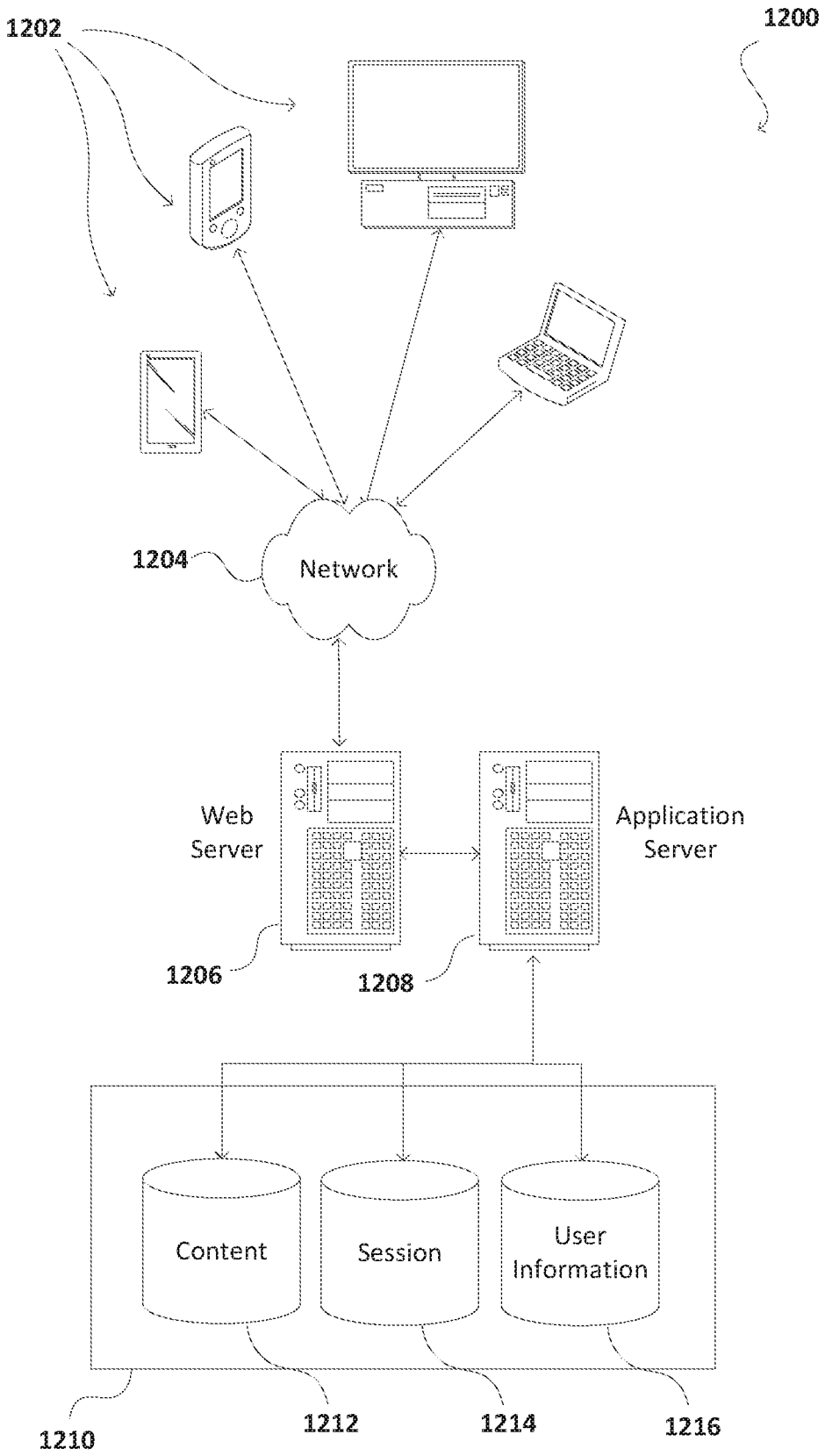
FIG. 12 illustrates an exemplary environment in which aspects of the various embodiments can be implemented.

As discussed, different approaches can be implemented in various environments in accordance with the described embodiments. For example, FIG. 12 illustrates an exemplary environment 1200 for implementing aspects in accordance with various embodiments, such as to obtain content to be rendered by a 3D or VR headset, or other such device or display. As will be appreciated, although a Web-based environment is used for purposes of explanation, different environments may be used, as appropriate, to implement various embodiments. The system includes an electronic client device 1202, which can include any appropriate device operable to send and receive requests, messages or information over an appropriate network 1204 and convey information back to a user of the device. This can include, for example, image information captured for the face of a user or a request for virtual reality content to be rendered on a virtual reality headset or other such device. Examples of client devices include personal computers, cell phones, handheld messaging devices, laptop computers, set-top boxes, personal data assistants, electronic book readers and the like. The network can include any appropriate network, including an intranet, the Internet, a cellular network, a local area network or any other such network or combination thereof. Components used for such a system can depend at least in part upon the type of network and/or environment selected. Protocols and components for communicating via such a network are well known and will not be discussed herein in detail. Communication over the network can be enabled via wired or wireless connections and combinations thereof. In this example, the network includes the Internet, as the environment includes a Web server 1206 for receiving requests and serving content in response thereto, although for other networks an alternative device serving a similar purpose could be used, as would be apparent to one of ordinary skill in the art.

The illustrative environment includes at least one application server 1208 and a data store 1210. It should be understood that there can be several application servers, layers or other elements, processes or components, which may be chained or otherwise configured, which can interact to perform tasks such as obtaining data from an appropriate data store. As used herein the term "data store" refers to any device or combination of devices capable of storing, accessing and retrieving data, which may include any combination and number of data servers, databases, data storage devices and data storage media, in any standard, distributed or clustered environment. The application server can include any appropriate hardware and software for integrating with the data store as needed to execute aspects of one or more applications for the client device and handling a majority of the data access and business logic for an application. The application server provides access control services in cooperation with the data store and is able to generate content such as text, graphics, audio and/or video to be transferred to the user, which may be served to the user by the Web server in the form of HTML, XML or another appropriate structured language in this example. The handling of all requests and responses, as well as the delivery of content between the client device 1202 and the application server 1208, can be handled by the Web server 1206. It should be understood that the Web and application servers are not required and are merely example components, as structured code discussed herein can be executed on any appropriate device or host machine as discussed elsewhere herein.

The data store 1210 can include several separate data tables, databases or other data storage mechanisms and media for storing data relating to a particular aspect. For example, the data store illustrated includes mechanisms for storing production data 1212 and user information 1216, which can be used to serve content for the production side. The data store also is shown to include a mechanism for storing log or session data 1214. It should be understood that there can be many other aspects that may need to be stored in the data store, such as page image information and access rights information, which can be stored in any of the above listed mechanisms as appropriate or in additional mechanisms in the data store 1210. The data store 1210 is operable, through logic associated therewith, to receive instructions from the application server 1208 and obtain, update or otherwise process data in response thereto. In one example, a user might submit a search request for a certain type of item. In this case, the data store might access the user information to verify the identity of the user and can access the catalog detail information to obtain information about items of that type. The information can then be returned to the user, such as in a results listing on a Web page that the user is able to view via a browser on the user device 1202. Information for a particular item of interest can be viewed in a dedicated page or window of the browser.

Each server typically will include an operating system that provides executable program instructions for the general administration and operation of that server and typically will include computer-readable medium storing instructions that, when executed by a processor of the server, allow the server to perform its intended functions. Suitable implementations for the operating system and general functionality of the servers are known or commercially available and are readily implemented by persons having ordinary skill in the art, particularly in light of the disclosure herein.

The environment in one embodiment is a distributed computing environment utilizing several computer systems and components that are interconnected via communication links, using one or more computer networks or direct connections. However, it will be appreciated by those of ordinary skill in the art that such a system could operate equally well in a system having fewer or a greater number of components than are illustrated in FIG. 12. Thus, the depiction of the system 1200 in FIG. 12 should be taken as being illustrative in nature and not limiting to the scope of the disclosure.

Various aspects can be implemented as part of at least one service or Web service, such as may be part of a service-oriented architecture. Services such as Web services can communicate using any appropriate type of messaging, such as by using messages in extensible markup language (XML) format and exchanged using an appropriate protocol such as SOAP (derived from the "Simple Object Access Protocol"). Processes provided or executed by such services can be written in any appropriate language, such as the Web Services Description Language (WSDL). Using a language such as WSDL allows for functionality such as the automated generation of client-side code in various SOAP frameworks.

Most embodiments utilize at least one network that would be familiar to those skilled in the art for supporting communications using any of a variety of commercially-available protocols, such as TCP/IP, FTP, UPnP, NFS, and CIFS. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business application servers. The server(s) also may be capable of executing programs or scripts in response requests from user devices, such as by executing one or more Web applications that may be implemented as one or more scripts or programs written in any programming language, such as JAVA®, C, C # or C++, or any scripting language, such as Perl, Python, or TCL, as well as combinations thereof. The server(s) may also include database servers, including without limitation those commercially available from ORACLE®, MICROSOFT®, SYBASE®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and other non-transitory computer readable media for containing code, or portions of code, can include any appropriate media known or used in the art, including storage media and communication media, such as but not limited to volatile and non-volatile, removable and non-removable media implemented in any method or technology for storage of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are illustrative of various embodiments of the present invention. The invention is not to be confined or restricted to any single embodiment, and the features of the various embodiments are conceived inclusive of one another, not exclusive to the embodiments in which they are discussed. It should be evident to a person skilled in the art that various modifications and changes may be made to the embodiments discussed without departing from the scope of the invention as set forth in the claims.

The invention claimed is:

1. A computer-implemented method for calibrating a printer, comprising:
- engaging at least one slitter a first location;
- printing a calibration target onto a print medium;
- transporting the print medium across the at least one slitter to cut the print medium;
- determining a calibration offset based on the position of the cut on the calibration target;
- receiving a print task; and
- printing the print task using the calibration offset.

2. The computer-implemented method of claim 1, further comprising:
- determining a gross portion of the calibration offset; and
- determining a fine portion of the calibration offset.

3. The computer-implemented method of claim 2, further comprising:
- adjusting the at least one slitter according to the gross portion of the calibration offset; and
- determining an active portion of an ink applicator to be used according to the fine portion of the calibration offset.

4. The computer-implemented method of claim 3, wherein determining an active portion of an ink applicator to be used includes digitally shifting an image associated with the print task.

5. The computer-implemented method of claim 3, wherein determining an active portion of an ink applicator to be used includes determining a calibrated reference ink applicator element.

6. The computer-implemented method of claim 1, wherein adjusting the at least one slitter includes adjusting a slitter bracket according to the gross portion of the calibration offset, the at least one slitter and a second slitter being attached to the slitter bracket.

7. The computer-implemented method of claim 6, further comprising:
- determining an inter-slitter calibration offset between the at least one slitter and the second slitter;
- determining that mechanical correction of the inter-slitter calibration offset is unobtainable; and
- modifying an image of the print task to accommodate for the inter-slitter calibration offset.

8. The computer-implemented method of claim 1, wherein the print task includes at least a first and a second image and the calibration offset enables the at least one slitter to separate the first image from the second image without substantial bleed-over.

9. The computer-implemented method of claim 1, wherein printing the print task is performed using a thermal printer.

10. A system, comprising:
- at least one processor; and
- memory including instructions that, when executed by the at least one processor, cause the system to:
  - engage at least one slitter a first location;
  - print a calibration target onto a print medium;
  - transport the print medium across the at least one slitter to cut the print medium;
  - determine a calibration offset based on the position of the cut on the calibration target;
  - receive a print task; and
  - print the print task using the calibration offset.

11. The system of claim 10, wherein the memory includes instructions that further cause the system to:
- determine a gross portion of the calibration offset; and
- determine a fine portion of the calibration offset.

12. The system of claim 11, wherein the memory includes instructions that further cause the system to:
- adjust the at least one slitter according to the gross portion of the calibration offset; and
- determine an active portion of an ink applicator to be used according to the fine portion of the calibration offset.

13. The system of claim 12, wherein determining an active portion of an ink applicator to be used includes digitally shifting an image associated with the print task.

14. The system of claim 12, wherein determining an active portion of an ink applicator to be used includes determining a calibrated reference ink applicator element.

15. The system of claim 10, wherein the instructions that cause the system to adjust the at least one slitter, further cause the system to:
- adjusting a slitter bracket according to the gross portion of the calibration offset, the at least one slitter and a second slitter being attached to the slitter bracket.

16. The system of claim 15, wherein the memory includes instructions that further cause the system to:
- determine an inter-slitter calibration offset between the at least one slitter and the second slitter;
- determine that mechanical correction of the inter-slitter calibration offset is unobtainable; and
- modify an image of the print task to accommodate for the inter-slitter calibration offset.

17. The system of claim 10, wherein the print task includes at least a first and a second image and the calibration offset enables the at least one slitter to separate the first image from the second image without substantial bleed-over.

18. The system of claim 10, wherein printing the print task is performed using a thermal printer.

19. A non-transitory computer readable storage medium comprising instructions that, when executed by a processor, cause a system to:

engage at least one slitter a first location;

print a calibration target onto a print medium;

transport the print medium across the at least one slitter to cut the print medium;

determine a calibration offset based on the position of the cut on the calibration target;

receive a print task; and print the print task using the calibration offset.

20. The non-transitory computer readable storage medium of claim 19, wherein the instructions, when executed by a processor, further cause the system to:

determine a gross portion of the calibration offset;

determine a fine portion of the calibration offset;

adjusting the at least one slitter according to the gross portion of the calibration offset; and determining an active portion of an ink applicator to be used according to the fine portion of the calibration offset.

* * * * *